United States Patent [19]

Mericle

[11] 4,155,283

[45] May 22, 1979

[54] WORKPIECE SUPPORTING APPARATUS FOR POWER TOOLS WITH HIGH SPEED CUTTING MEMBERS

[76] Inventor: John E. Mericle, 2202 Torrey, Tucson, Ariz. 85710

[21] Appl. No.: 842,500

[22] Filed: Oct. 17, 1977

[51] Int. Cl.[2] ..... B27B 25/10

[52] U.S. Cl. ..... 83/409; 83/435.1; 269/54.3

[58] Field of Search ..... 83/435.1, 409, 745; 269/543, 542

[56] References Cited

U.S. PATENT DOCUMENTS

| | | | |
|---|---|---|---|
| 259,551 | 6/1882 | Kester | 83/435.1 |
| 1,871,713 | 8/1932 | Lowenthal | 269/54.3 |
| 2,001,306 | 5/1935 | Gressner | 83/435.1 |
| 2,664,926 | 1/1954 | Fuglie | 83/435.1 |
| 2,895,513 | 7/1959 | Cowley | 83/435.1 |
| 3,286,744 | 11/1966 | Stall et al. | 83/409 |

*Primary Examiner*—Donald R. Schran
*Attorney, Agent, or Firm*—Cahill, Sutton & Thomas

[57] ABSTRACT

A workpiece supporting apparatus provides precise linear movement of an irregularly edged workpiece past the high speed cutting member of a power tool to produce a trimmed straight edge on the workpiece. The supporting apparatus includes an elongated keying member cooperating with a precision miter groove or guide member of the power tool to guide the workpiece past the cutting member. The elongated keying member has first and second workpiece engaging assemblies which may be adjustably positioned along the axis of the elongated keying member to accommodate various length workpieces. Each of the workpiece engaging assemblies includes conical point members mounted upon spindles for engaging an end of the workpiece and for providing rigid support therefor. As the workpiece supporting apparatus is manually moved past the cutting member, the precision miter groove precisely guides the elongated keying member so that a straight, precise cut is produced on the irregularly edged workpiece.

11 Claims, 9 Drawing Figures

WORKPIECE SUPPORTING APPARATUS FOR POWER TOOLS WITH HIGH SPEED CUTTING MEMBERS

BACKGROUND OF THE INVENTION

1. Field of the Invention

The invention relates to workpiece supporting apparatus for use in conjunction with power tools, such as circular saws, having high speed cutting members. More precisely, the invention relates to apparatus for supporting irregularly edged or surfaced workpieces in a predetermined relationship to the high speed cutting member.

2. Brief Description of the Prior Art

In woodworking, precision cutting such as sawing, notching, dadoing, etc., of a workpiece is often necessary. However, difficulty is encountered for such operations if the precision cutting must be done on a workpiece which does not have a flat surface or edge positionable adjacent an adjustable guide fence. Additionally, a workpiece surface which is available for cooperation with a guide fence may be quite irregular and may provide inadequate or unstable support.

For example, many common types of wood, especially soft boards of pine, fir or spruce, may become severely warped by changes in temperature, humidity, or merely by uneven pressures resulting from the manner in which the boards are stored. In order to avoid wasting of such warped and otherwise irregular boards it is frequently necessary to rip them to provide boards which have precisely cut parallel opposite edges.

To accomplish this end, various techniques have been used to rip such warped and irregular boards. One technique has simply been to guide an irregular edge of the warped board along the fence of a table saw. Accomplishment of such ripping is made more difficult by the fence member of certain table saws in that many such fence members are securely mounted at only one end. Such fence members may temporarily spring out of shape due to forces impressed against them during ripping of a badly warped board. During ripping, the warped board may cause "binding" of the high speed cutting edge of a saw blade, causing the wood to become hot and smoke. Frequently the cutting edge of the saw blade is heated to such a high temperature that the saw blade metal looses its temper and the cutting edge quickly becomes dull. The saw blade is useless once it has lost its temper, since it can not then be satisfactorily resharpened. Worse yet, the saw blade may grasp or "dig" into the warped board and propel it with sufficient force to endanger the workman.

Another technique has been that of employing a joiner to precisely straighten one edge of the irregular board; subsequently, a circular saw and a fence member thereof to guide the straightened edge may then be used to rip the irregular board to a predetermined width. However, a suitable joiner is an expensive tool and may not be available. Moreover, the process of making multiple passes of the irregular edge of the irregular board on a joiner may be a very time-consuming procedure and not justified in certain circumstances. Another possible solution to the problem is that of temporarily attaching (by clamping or nailing) a straight edge to the irregular board and pressing the temporary straight edge against the fence member of the power tool to guide the irregular board as it is moved past the cutting member. Again, this is an inconvenient and unwieldy procedure and has the detrimental effect of leaving permanent marks on the workpiece.

Various mechanisms have been utilized to secure a workpiece as it is moved past a rotary saw, as described and illustrated in U.S. Pat. Nos. 3,457,972 and 2,918,953. Various known fences and other equipment for use in conjunction with rotary saws and keyed with one or more grooves in the surface member of the rotary saw; but, such devices are very unwieldy and are unsuited to solving the problems discussed above.

SUMMARY OF THE INVENTION

Accordingly, it is an object of the invention to provide an apparatus for conveniently making precise, straight cuts in an irregular workpiece.

Another object of the invention is to provide an apparatus for conveniently and precisely ripping an irregular board into a board with two flat, parallel opposite edges without guiding the board against a fence member as the board is being ripped.

Briefly described, the invention is a workpiece supporting apparatus for use in conjunction with a power tool having a high speed cutting member. The supporting apparatus rigidly supports the workpiece to permit precise linear movement of the workpiece past the high speed cutting member. The supporting apparatus thereby aids producing one or more precise, linear cuts in the workpiece. The workpiece supporting apparatus includes an elongated keying member, and further includes first and second workpiece engaging assemblies. The workpiece engaging assemblies are adjustably attached to the elongated keying member to accommodate various length workpieces. Each workpiece engaging assembly has two laterally spaced conical points for effecting rigid, penetrating engagement of opposed ends of the workpiece. The elongated keying member has precise, straight edges which may be aligned against machined surfaces of a miter groove in a working surface of the power tool. Alternately, the straight edges of the elongated keying member may be positioned in continuous slidable contact with a guide member attached to a working surface of the power tool. Workpieces such as warped or twisted boards may thereby be easily ripped into boards which have straight, parallel edges without guiding an irregular edge of the workpiece along a fence member of the power tool.

Figure 4:
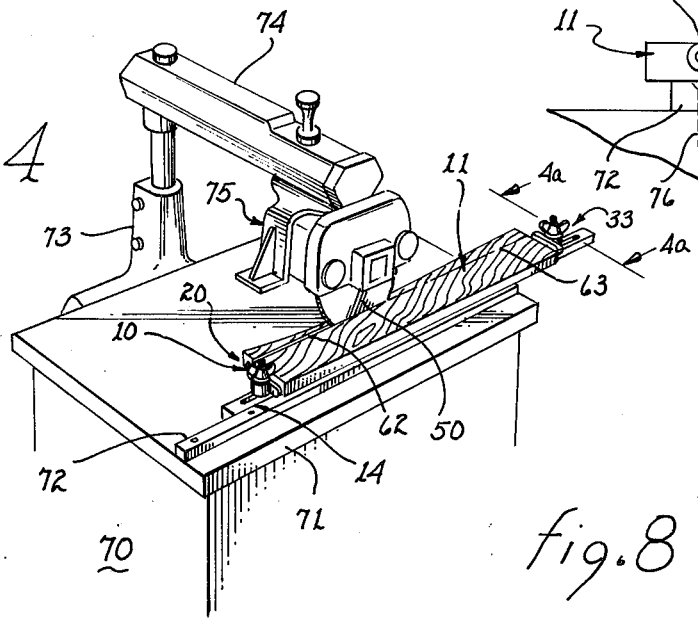
FIG. 4 is a perspective drawing of the supporting apparatus and workpiece in combination with a radial arm saw.

FIG. **4*a* is a cross-sectional diagram of the supporting apparatus and workpiece taken along the lines 4*a*—4*a*, as shown in FIG. 4**.

Figure 5:
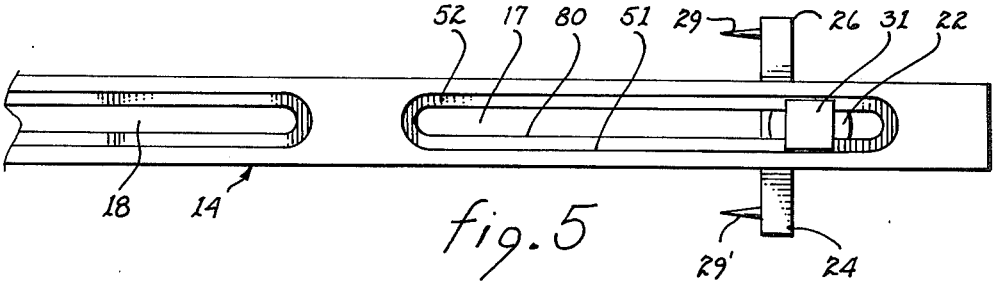

FIG. 5 is a partial bottom plan view of the supporting apparatus.

Figure 6:
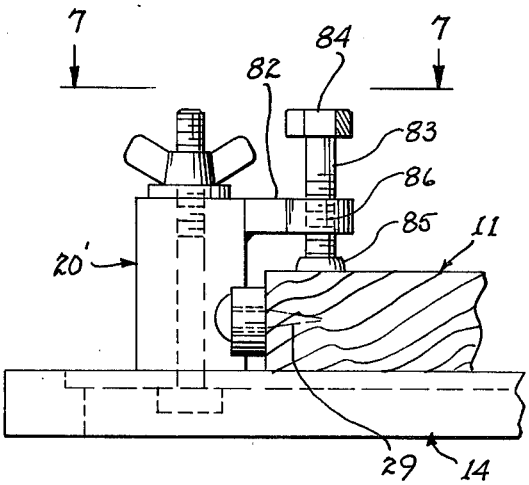

FIG. 6 illustrates a cross-sectional view of an alternate embodiment of a workpiece engagement apparatus.

Figure 7:
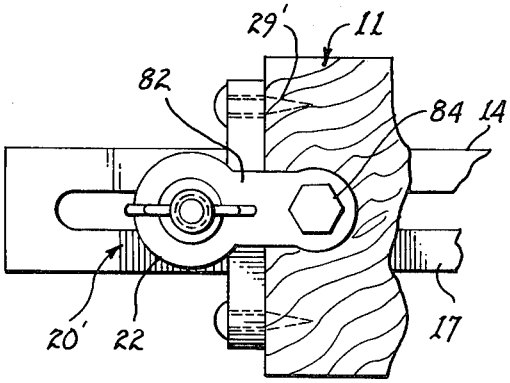

FIG. 7 is a top plan view of the embodiment shown in FIG. 6.

Figure 8:
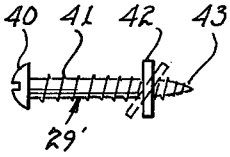

FIG. 8 illustrates a thread conical pin.

DESCRIPTION OF THE INVENTION

Figure 1:
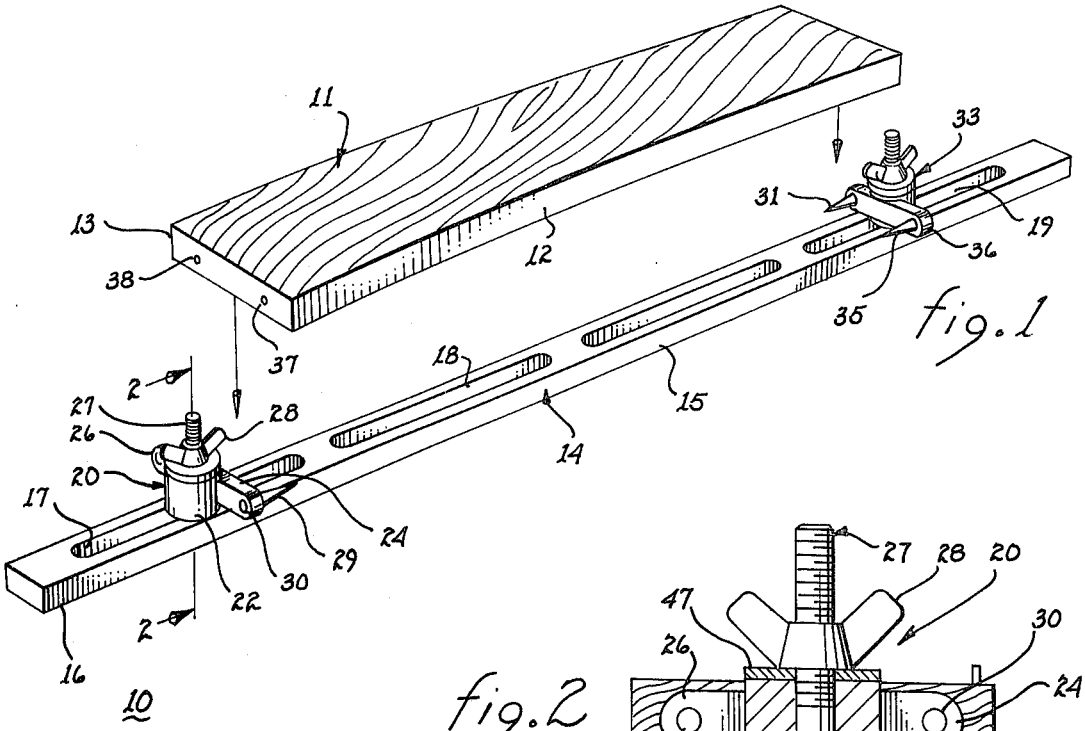
FIG. 1 is a perspective view of a supporting apparatus and workpiece.

Referring particularly to FIG. 1, workpiece supporting apparatus 10 includes an elongated keying member 14 having a substantially rectangular cross-section. Its edges 15 and 16 form straight precise parallel surfaces. Elongated keying member 14 includes a plurality of elongated slots 17, 18, and 19 aligned with the major longitudinal axis of elongated keying member 14. Elongated grooves 17, 18, and 19 are utilized to facilitate adjustable securing of workpiece engaging assembly 20 to elongated keying member 14.

Workpiece engaging assembly 20 includes a cylindrical body 22 having transverse support members 24 and 26 extending laterally outwardly therefrom. Lateral support arms 24 and 26 have threaded apertures 30 and 34 therein. A threaded spindle having a conical centering point 29 is screwed into threaded aperture 30. Another conical centering point 29' is screwed into aperture 34 so that the conical centering points engage locations 37 and 38 of the end of workpiece 11. (Workpiece 11 is illustrated in FIG. 1 as a rectangular board, although other shapes or workpieces may, of course, be so engaged.)

The structure of workpiece engaging assembly 33 is essentially identical to that of workpiece engaging assembly 20, except that it has conical centering points 31 and 35 pointing in the opposite direction from conical centering points 29 and 29'. Workpiece engaging assembly 33 is adjustably fastened to elongated keying member 14 by means of groove 19.

Figure 2:
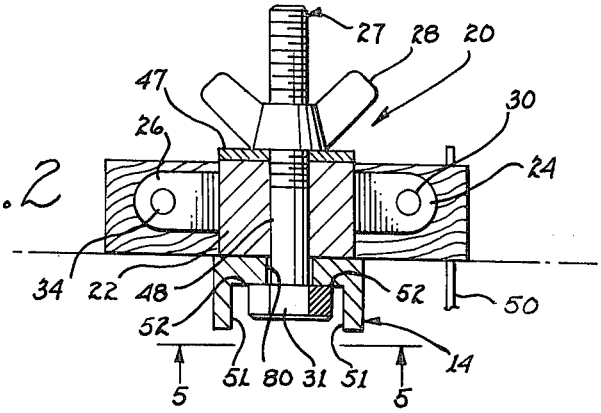
FIG. 2 is a cross-sectional view of the workpiece engaging assembly taken along the lines 2—2, as shown in FIG. 1.

Workpiece engaging assembly 20 is adjustably fastened to elongated keying member 14 by means of bolt 27, as shown in FIG. 2. Bolt 27 extends through slot 17 of elongated keying member 14 and through opening 48 in workpiece engaging assembly 20. Bolt 27 and wing nut 28 are utilized to facilitate adjusting the position of workpiece engaging assembly 20 along elongated keying member 14 and then locking the workpiece engaging assembly into the desired position by tightening wing nut 28. The shaft of bolt 27 extends through opening 48 in cylindrical member 22 and also through a narrow portion of groove 17 of elongated keying member 14. A hexagonal head of bolt 27 is seated against flat shoulder 52 which bridges a gap between wall 80 and wall 51 the wider lower portion of slot 17. See both FIGS. 2 and 5. Shoulder 52 of slot 17 extends outwardly a uniform distance from wall 80 to wall 51 and is a machined flat surface along its entire length. The arrangement of hex head 31 of bolt 27 against shoulder 52 within the enlarged portion of slot 17 is clearly shown from the bottom view of FIG. 5. Hex head 31 of bolt 27 is tightened against shoulder 52 as wing nut 28 is tightened.

Workpiece 11 may be a rather severely warped board, or some other piece of material which does not have a flat surface to permit it to be effectively slid along a fence member of a power tool in order to enable one to accurately cut a straight cut therein.

Figure 3:
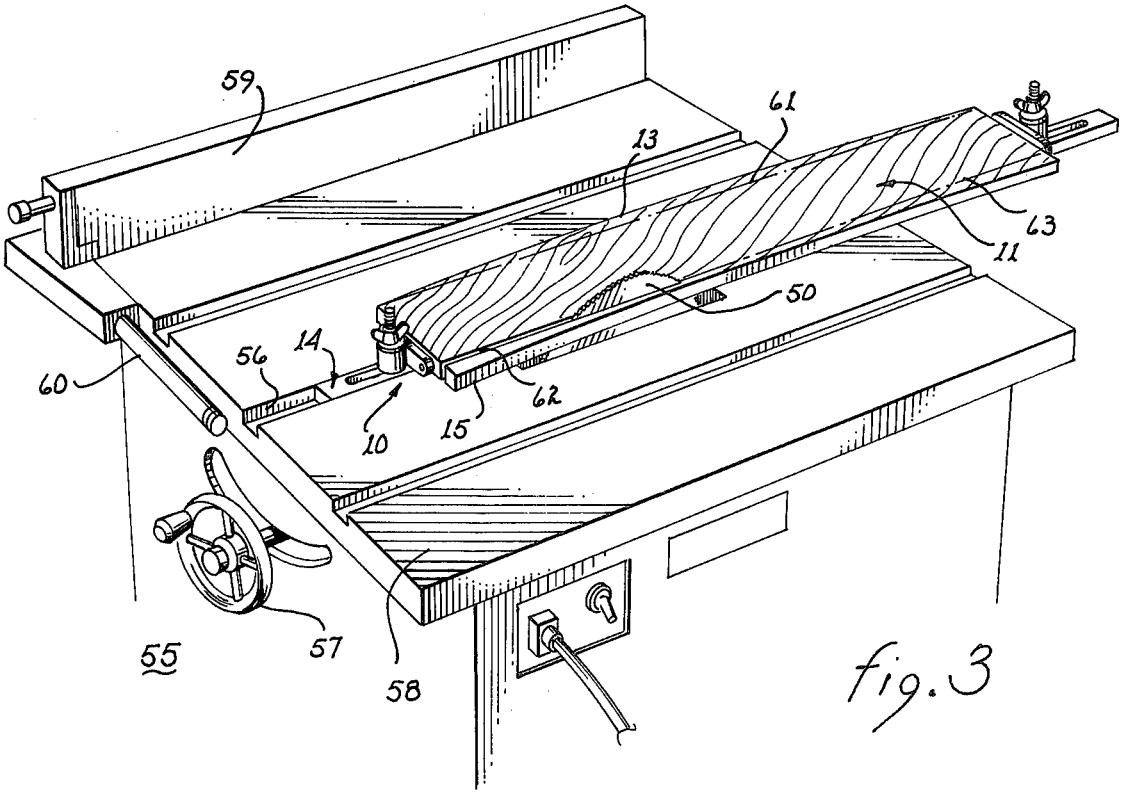
FIG. 3 is a perspective diagram of the supporting apparatus in combination with a table saw.

FIGS. 2 and 3 illustrate the utilization of the supporting apparatus and the workpiece in combination with a conventional table saw 55. Table saw 55 includes a working surface member 58 which has a plurality of straight, precision miter grooves, such as miter groove 56 therein. Supporting apparatus 10 and workpiece 11, which is rigidly clamped between workpiece engaging assemblies 20 and 33, are positioned in FIG. 3 such that elongated keying member 14 is snugly but slidably positioned in miter groove 56. FIG. 3 shows two straight "intended cut lines" 61 and 63 on workpiece 11. As illustrated in FIG. 3, a partial cut 62 has been made in warped workpiece 11 by circular saw blade 50 along straight intended cut line 63.

Clearly, warped board 11 cannot be conveniently ripped even if fence member 59 of table saw 55 is positioned in partial contact with warped edge 13 of workpiece 11. If this method of ripping workpiece 11 along straight intended cut lines were attempted, the path of saw blade 50 would trace an arc substantially parallel to the arc of curved edge 13 instead of cutting along the straight intended cut lines 63 and 61. It is further quite likely that saw blade 50 would bind against the walls of the cut, causing saw blade 50 to overheat, loose its temper and rapidly become dull. The overheating of the saw blade would be likely to produce smoking and discoloration of the board. The binding of saw blade 50 could sieze the workpiece and destructively hurl it away from the table saw 55, possibly endangering or injuring the operator.

In contrast, however, it is clear that operation of the system as illustrated in FIG. 3 readily permits supporting apparatus 10 and rigidly supported workpiece 11 to be easily moved in linear, guided motion past circular saw blade 50. The linear, guided motion is effected by the sliding of elongated keying member 14 within precision miter groove 56, thereby causing saw blade 50 to cut a true and straight cut along intended cut lines 61 and 63. Consequently, there is no danger of binding of saw blade 50 within cut 62.

After cut 62 is completed, wing nut 28 may be loosened. Workpiece engaging assembly 20 is then moved slightly away from workpiece 11 to disengage the conical points on the respective ends of workpiece 11. Workpiece 11 is then re-positioned so that saw blade 50 can cut along intended cut line 61. The workpiece engaging assemblies 20 and 33 are then forced toward each other to securely engage workpiece 11 as the respective conical points again pierce the ends of board 11. Wing nut 28 is then retightened. The cut along intended cut line 61 may then be completed. The ripped board thus obtained has precisely cut parallel opposite edges along the intended cut lines 61 and 63. Alternatively, the cut straight edge can be positioned adjacent a standard fence to develop the second straight edge.

If workpiece 11 is twisted as well as warped, workpiece supporting apparatus 10 permits workpiece 11 to be physically twisted into an untwisted configuration by the counter-torque of elongated keying member 14. The twisted workpiece may be straightened immediately before being engaged by workpiece engaging assemblies 20 and 21. The counter-torque of the elongated keying member 14 tends to counteract the "twist" of the board, making it somewhat easier to remove the remaining "twist" during the sawing operation by pressing workpiece 11 firmly downward against the flat, machined surface of table member 58 as the workpiece and workpiece supporting apparatus 10 are moved past circular saw blade 50. This also prevents any binding of elongated keying member 14 within machined groove 56. When the ripped board is subsequently utilized in an application in which its "twist" is removed by nailing the ripped board to some sort of rigid structure, the opposite surfaces of the cuts along lines 61 and 63 will then be prefectly parallel, permitting tight joints with other boards to be achieved.

Figure 4A:
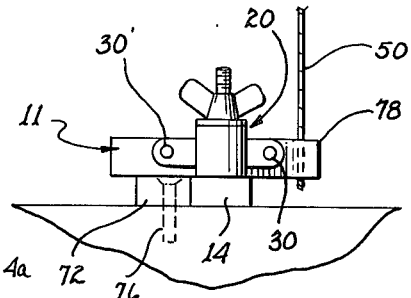

FIGS. 4 and 4*a* illustrate the utilization of the supporting apparatus and rigidly held workpiece in conjunction with a radial arm circular saw. The embodiment of FIGS. 4 and 4*a* further illustrates an alternative means of guiding the supporting apparatus. Blade 50 and driving motor assembly 75 are suspended over working surface member 71 by means of arm member 74 and column support member 53. There is no slot in working surface member 71 to accommodate blade 50. However, a guide member 72 having a straight machined guide surface is attached to the surface of bench surface member 71 in a suitable fashion, for example, by means of clamps, or preferrably, by means of bolts, such as bolt 76 illustrated in FIG. 4*a*. Saw blade 50 and motor assembly 75 may be readily positioned at the desired distance along arm 74 to locate blade 50 at the beginning of intended cut line 63 before beginning cut 62. Elongated keying member 14 is initially pressed against guide member 72, which has the same thickness as elongated keying member 14. Elongated keying member 14 is slid along the machined guide surface of guide member 72; consequently, part of the lower surface of workpiece 11 is slid along the upper surface of guide member 72. (Of course, guide member 72 and keying member 14 may both be wider than illustrated in FIG. 4 to provide more stable upward support for board 11.)

Another embodiment of workpiece engaging assembly 20 is illustrated in FIG. 7. This embodiment is similar in structure and operation to the workpiece engaging assemblies illustrated in the preceding figures except for the addition of cantilever arm 82. A bolt having a head 84 is screwed into threaded opening 86 of cantilever member 82. A rotatable, loosely fitting pressure collar 85 is provided on the end of bolt 83 so that it contacts the upper surface of workpiece 11 to apply vertical pressure thereon. However, pressure collar 85 does not turn as bolt shaft 83 turns, thereby avoiding damage caused by the digging of bolt 83 into the upper surface of workpiece 11.

Various alternatives to the arrangements shown in the drawings are possible. For example, it is not necessary that the high speed cutting member be the circular saw blade 50 shown in the drawings. Clearly, the workpiece supporting apparatus of the invention may also readily be utilized in conjunction with a router, a band saw, a grinding machine, a dado machine, etc.

The conical pin points may be modified, as indicated in FIG. 8, to permit them to more suitably engage a regular surface of the workpiece. In FIG. 8, threaded conical pin structure 29'' includes a collar 42 which applies pressure against the workpiece once conical point 43 has penetrated into the workpiece. As indicated by the dotted line, collar 42 may be arranged to be rotatably secured within the structure of the spindle 41 so that it is capable of sloping with respect to the axis of spindle 41. Of course, the conical points need not be precisely conical. They may be of any suitable pointed configuration, such as pyramidal, for example. A graduated scale may be provided on lateral support members 24 and 26 to aid precise positioning of workpieces between workpiece engaging assemblies 20 and 33 so as to avoide damage to the workpiece.

In summary, the invention provides a workpiece supporting apparatus for use in conjunction with power tools such as radial saws, table saws, and the like for safely guiding an irregular workpiece past high speed cutting members without use of a fence member. The workpiece supporting apparatus differs from known devices for guiding workpieces past a high speed cutting member by provision of a pair of adjustable workpiece engaging assemblies adjustably mounted on a single precision support member, which may be guided by means of precision miter groove or other guide member. The workpiece supporting apparatus is safe and easy to utilize, avoids damage to the workpiece, and is capable of engaging highly irregular workpieces. It thereby enables the user to utilize warped or otherwise irregular boards or workpieces which otherwise would be wasted. Considering that most quality wood purchased for furniture building very seldom has straight edges, the presnet invention will enable those who don't have access to phaners, joiners etc. to achieve straight edges for glue joints.

I claim:

1. A workpiece supporting apparatus guided by a guideway for translating a workpiece parallel to the guideway past the cutting member of a power tool to produce a straight precision cut in the workpiece, said apparatus comprising in combination:

(a) an elongated keying member having an upper surface and a lower surface, said keying member being translatable along the guideway;

(b) vertical slot means disposed in said keying member and extending intermediate the upper and lower surfaces thereof, said slot means including a laterally expanded portion having sidewalls and a shoulder; and (c) first and second workpiece engaging means oriented upon said keying member in opposed relationship to one another for engaging opposed end surfaces of the workpiece, each of said first and second workpiece engaging means comprising:

i. means for retaining an end surface of the workpiece;

ii. a body for supporting said retaining means;

iii. post means extending upwardly through said slot means for securing said body to said keying member, said post means being slidable along said slot means to accommodate different length workpieces and including head means for engaging said side walls to prevent rotation of said post means and for engaging said shoulder to limit upward travel of said post means; and iv. means for maintaining said body upon said post means and frictionally locking said head against said shoulder;

whereby, the end surfaces of the workpiece are secured to said keying member intermediate said first and second workpiece engaging means and the workpiece is translatable past the cutting member on movement of said keying member along the guideway.

2. The workpiece as set forth in claim 1 wherein said slot means comprises first and second slot means disposed serially along said keying member for supporting said first and second workpiece engaging means, respectively.

3. The workpiece as set forth in claim 2 wherein said retaining means comprises a pointed spindle for penetrating engagement with an end surface of the workpiece.

4. The workpiece as set forth in claim 3 including adjustment means for repositioning said spindle with respect to said body to obtain greater or lesser penetration of the end surface of the workpiece.

5. The workpiece as set forth in claim 1 wherein said retaining means comprises at least two horizontally displaced parallel pointed spindles for penetrating engagement with an end surface of the workpiece to prevent tilting of the engaged workpiece.

6. The workpiece as set forth in claim 5 wherein said body includes a first transverse support member for supporting one of said pointed spindles and a second transverse support member for supporting another of said pointed spindles.

7. The workpiece as set forth in claim 6 wherein said post means comprises a threaded bolt and said retaining means comprises a wing nut.

8. The workpiece as set forth in claim 7 wherein said body includes an opening for penetrably receiving said bolt.

9. The workpiece as set forth in claim 1 including clamp means cooperating with said retaining means for exerting, in combination with said retaining means, a two directional retaining force upon an end of the workpiece.

10. A workpiece supporting apparatus for translating a workpiece parallel to a guideway of the work surface of a power tool and past a cutting member of the power tool to produce a straight precision cut in the workpiece, said apparatus comprising in combination:

(a) a slotted elongated keying member for supporting the workpiece, said keying member being translatable along and guided by the guideway; and (b) first and second workpiece engaging means attachable to and oriented upon said keying member in opposed relationship to one another for engaging opposed end surfaces of the workpiece, each of said workpiece engaging means comprising:

i. means for penetratingly retaining an end surface of the workpiece at two points;

ii. a body for supporting said retaining means;

iii. post means slidable along a slot within said keying member for supporting said body; and iv. means for securing said body to said post means and positionally locking said post means to the slot;

whereby, the end surfaces of the workpiece are secured to said keying member intermediate said first and second workpiece engaging means and the workpiece is translatable past the cutting member on movement of said keying member along the guideway.

11. A workpiece supporting apparatus for translating a workpiece parallel to a guideway of the work surface of a power tool and past a cutting member of the power tool to produce a straight precision cut in the workpiece, said apparatus comprising in combination:

(a) an elongated keying member for supporting the workpiece, said keying member being translatable along and guided by the guideway;

(b) first and second means for rigidly attaching opposed end surfaces of the workpiece to said keying member, said first and second means being positionable along said keying member in conformance with the workpiece, each of said first and second means comprising:

i. a body, said body including laterally extending members and spindles supported upon said laterally extending members for engaging the end surface of the workpiece;

ii. post means for supporting said body; and iii. means for securing said body to said post means and locking said post means with respect to said keying member;

whereby, the end surfaces of the workpiece are secured to said keying member intermediate said first and second workpiece engaging means and the workpiece is translatable past the cutting member on movement of said keying member along the guideway.

* * * * *